US006158261A

United States Patent [19]

Utyashev et al.

[11] Patent Number: 6,158,261

[45] Date of Patent: Dec. 12, 2000

[54] MILL FOR PRODUCING AXIALLY SYMMETRIC PARTS

[75] Inventors: Farid Zainullaevich Utyashev; Oskar Akramovich Kaibyshev; Vener Anvarovich Valitov, all of Bashkotorstan, Russian Federation

[73] Assignee: General Electric Company, Schenectady, N.Y.

[21] Appl. No.: 09/254,888

[22] PCT Filed: Jul. 12, 1998

[86] PCT No.: PCT/US98/14454

§ 371 Date: Mar. 15, 1999

§ 102(e) Date: Mar. 15, 1999

[87] PCT Pub. No.: WO99/03617

PCT Pub. Date: Jan. 28, 1999

[30] Foreign Application Priority Data

Jul. 14, 1997 [RU] Russian Federation ..... 9711607

[51] Int. Cl.[7] ..... B21H 1/04

[52] U.S. Cl. ..... 72/69; 72/87

[58] Field of Search ..... 72/69, 86, 87

[56] References Cited

U.S. PATENT DOCUMENTS

| | | | |
|---|---|---|---|
| 1,534,860 | 4/1925 | Martin | 72/69 |
| 1,605,755 | 11/1926 | Michelin | 72/69 |
| 1,795,379 | 3/1931 | Schmidt | 72/84 |
| 2,750,820 | 6/1956 | Greenshields | 80/60 |
| 3,257,835 | 6/1966 | Cofer et al. | 72/38 |
| 4,154,076 | 5/1979 | Tuschey et al. | 72/69 |
| 4,820,358 | 4/1989 | Keh-Minn | 148/13 |

FOREIGN PATENT DOCUMENTS

| | | | |
|---|---|---|---|
| 4429801 | 2/1996 | Germany . | |
| 19545177 | 8/1996 | Germany . | |
| 54-101757 | 10/1979 | Japan . | |
| 58-025834 | 2/1983 | Japan . | |
| 60-124427 | 7/1985 | Japan . | |
| 60-124428 | 7/1985 | Japan . | |
| 63-10033 | 1/1988 | Japan | 72/69 |
| 2031753 | 3/1995 | Russian Federation . | |
| 727287 | 4/1980 | U.S.S.R. . | |
| 1491603 | 7/1989 | U.S.S.R. . | |
| 9748509 | 12/1997 | WIPO . | |

OTHER PUBLICATIONS

Derwent Database WPI, Abstract AN 95–342896, Sec. Ch. Week 9544.

Derwent Database WPI, Abstract AN 80–L 3029C, Sec. PQ, Week 8047.

Derwent Database WPI, Abstract AN 90–006310, Sec. PQ, Week 9001.

Patent Abstracts of Japan, v. 007, No. 104(m–212), May 6, 1983.

Patent Abstract of Japan, v. 003, No. 123(C–061), Oct. 16, 1979.

Patent Abstracts of Japan, v. 009, No. 282 (m–428) Nov. 9, 1985.

*Primary Examiner*—Lowell A. Larson

*Attorney, Agent, or Firm*—Noreen C. Johnson; Douglas E. Stoner

[57] ABSTRACT

A mill for producing axially symmetric parts which has a means (35, 36) for fixing the billet under process with a possibility of its rotating about its own axis, rolling rolls (1, 2, 3, 4), a working furnace (44) provided with openings for inserting the rolling rolls therein, and means for control and monitoring the billet processing conditions, comprising means for monitoring and changing the load applied to the rolling rolls and the billet under process, as well as means for establishing a specified temperature gradient in the individual portions of the billet. The mill is intended for producing wheels, disks, and other axially symmetric parts from superalloys.

40 Claims, 9 Drawing Sheets

MILL FOR PRODUCING AXIALLY SYMMETRIC PARTS

BACKGROUND ART

The present invention relates in general to plastic metal working and more specifically to constructions of machinery, for instance mills for rolling axially symmetric parts such as wheels and disks, and can find application for producing such parts from low-plastic hard-to-work materials, such as superalloys.

A number of prior-art mills for producing axially symmetric parts are known to comprise a working tool usually appearing as a pair of rotatable rolls fitted in rolling heads movable with respect to the billet under process by means of carriages which in turn are traversable along bedways. The billet is fitted in the mill rotatably about its own axis (cf. USSR Inventor's Certificate No. 275,039).

The aforementioned devices are used for producing such parts as the wheels of railway stock which are comparatively simple in construction, from materials that are plastic within a wide temperature range, such as carbon steels.

One more prior-art device is known to comprise a top and a bottom roll for shaping the wall of a part, both rolls being driven in rotation in a definite sense and arranged opposite to each other on both sides of the walls of a disk-like billet with a possibility of synchronous up-and-down and radial motion imparted by appropriate drives, a rotatable mandrel supported on a stationary fixed vertical axle, a rotatable and vertically movable side roll arranged opposite to the rotatable mandrel and aimed at supporting the billet between said roll and the mandrel, a top and a bottom edging roll exerting vertical pressure on the billet surface and supported with a possibility of radial motion, radially movable guide rollers rotatable while getting in contact with the billet end face, and a number of rotatable backup rollers (cf. Japanese Patent Publication SHO-61-11696).

The device mentioned before is suitable, due to a complicated kinematic features of the tool and provision of numerous rolls, for producing disk-type parts having more intricate configuration likewise from plastic materials.

The above-described devices cannot, however, be used for producing such parts as gas-turbine disks from hard-to-work high-temperature materials, e.g., nickel- and titanium-base alloys.

A further prior-art rolling mill is known to comprise bed-mounted rolling heads whose number is multiple of two, provided with drives imparting rotation, vertical and horizontal motion thereto, each of said rolling heads having its own carriage which is bed-mounted and independently movable in mutually square direction in a horizontal plane, and a mechanism for turning the rolling head in a horizontal plane. The mill under consideration further comprises a working furnace into which the billet is placed after having been preheated in a preheater furnace. The mill further comprises two coaxial billet holding units and a mechanical actuator imparting rotation thereto. The working furnace has openings for the rolls and part of the billet holding unit to insert therein. The billet holding unit comprises also a mandrel. The required contour of the part being produced is formed when the rolls move from the center towards the periphery along a preset pathway (cf. RU Patent No. 2,031,753).

The mill, according to said patent, is suitable for producing a number of parts, predominantly simple in shape, from hard-to-work alloys. With a view to observing isothermal or superplastic conditions, plastic working of such billets should be performed in a working furnace. This is necessary for increasing the plasticity of material and reducing its yield stress. At high temperatures the material features a low yield stress. Uncontrolled additional strain of the already worked billet areas occurs due to too a low yield stress, as well as owing to the fact that under superplastic conditions the dimensions of the strain center exceed substantially the area of direct action of the rolls on the billet under process. This in turn results ultimately in spoilage. Use of a mandrel to some extent restricts unintentional thinning of the billet; however, a mandrel can be used only in producing parts of a relatively small diameter having but a small difference in thickness between the already rolled billet areas and its area under rolling. Otherwise the plastically worked billet areas get thinned despite the use of a mandrel, this being due to the heavy rolling forces to be applied. That is why the mill in question is applicable only for producing disk-type axially symmetric parts from hard-to-work alloys, having relatively simple configuration and a diameter of from 500 to 800 mm, with large preset working allowances for fear of thinning the web during the rolling process.

It is noteworthy that up-to-date requirements imposed on critical parts produced by plastic working techniques include not only attaining an accurate shape and size of a part approximating the finished ones but also its microstructure, which is to a great extent decisive for mechanical and performance characteristics of the part involved. The preset specified microstructure of such parts is to be established during their plastic working, for which purpose a device for their producing must provide varying thermal and mechanical conditions of the working process. However, such a possibility is not provided in the known devices of the character set forth before.

SUMMARY OF THE INVENTION

The foregoing object is accomplished in a number of possible variants of the mill, according to the invention. In a first variant, provision of a specified structure in the material of the billet under process is ensured due to establishing a temperature gradient between its individual portions. In a second variant the object is attained by changing the conditions of mechanical treatment of the billet involved. In a third variant the mill incorporates the features of both the first and second variants, that is, means for establishing a temperature gradient in the billet under process and means for changing the conditions of mechanical billet treatment.

According to any one of the variants mentioned above, the mill comprises:

- means for holding the billet under process with a possibility of its rotating about its own axis;
- at least one rolling roll adapted to be in contact with the surface of the billet during its processing;
- means for setting in rotation at least said roll or said billet;
- a working furnace in which placed at least partly are the billet under process and its holding means, said furnace having openings for rolling rolls to insert therein;
- means for control and monitoring the billet processing conditions.

According to the invention, in the first variant of the proposed mill it is provided with means for establishing a temperature gradient between the individual billet portions. The aforementioned means may be of diverse construction arrangement, in particular, they may appear as a number of heaters provided in the mill and so selected as to suit the required temperature gradient. The heaters may be lodged in recesses of the furnace wall arranged along concentric circles coaxial with the billet under process.

The aforementioned temperature gradient may be established also by virtue of heat withdrawal from individual billet zones, this being due to the provision of the mill with a source of refrigerant, said source communicating with passages in the rolling rolls or in the billet holding units.

Control of said means for establishing a temperature gradient in the billet under process may be effected against signals delivered by sensors of temperature of the billet under process, or by sensors of mechanical load applied to the rolling roll and the billet under process, or else by the billet contour sensors, the latter being reasonable to appear as optoelectronic ones.

In a mill embodiment involving control of mechanical action on the billet under process, means for setting in rotation the rolling roll or the billet under process, or both, are capable of reversing rotation of said roll and/or said billet and of disengaging both of them from the drive in the course of billet rolling. The driving means are controlled by signals from either the sensors of load applied to the rolling roll and the billet or from the billet contour sensors. The mill may be furnished with an additional pressure roller provided with an actuator imparting translational motion thereto parallel to the axis of billet rotation and lengthwise the billet radius, said actuator being controlled by signals from said sensors of load applied to the rolling roll and the billet or from said billet contour sensors. In addition, the rolling roll may be equipped with a mechanism adapted to displace said roll to a position where the axis of its rotation does not intersect the axis of billet rotation, said mechanism being controlled by signals from said sensors of load applied to the rolling roll and the billet under process or from said billet contour sensors. The mill may also be provided with a mechanism adapted to displace the billet under process lengthwise its own axis.

According to a combined embodiment of the present mill it is provided with said means for establishing temperature gradient in the billet under process, controlled by signals of either billet temperature sensors, or sensors of load applied to the billet and rolling roll, or sensors of billet contour, as well as with driving means capable of reversing rotation of said roll and/or said billet and of disengaging both of them from the drive, and controlled by signals from said billet load sensors or from said billet contour sensors.

BRIEF DESCRIPTION OF THE DRAWINGS

The present invention is illustrated by the following drawings, wherein.

DESCRIPTION OF THE INVENTION

Figure 1:
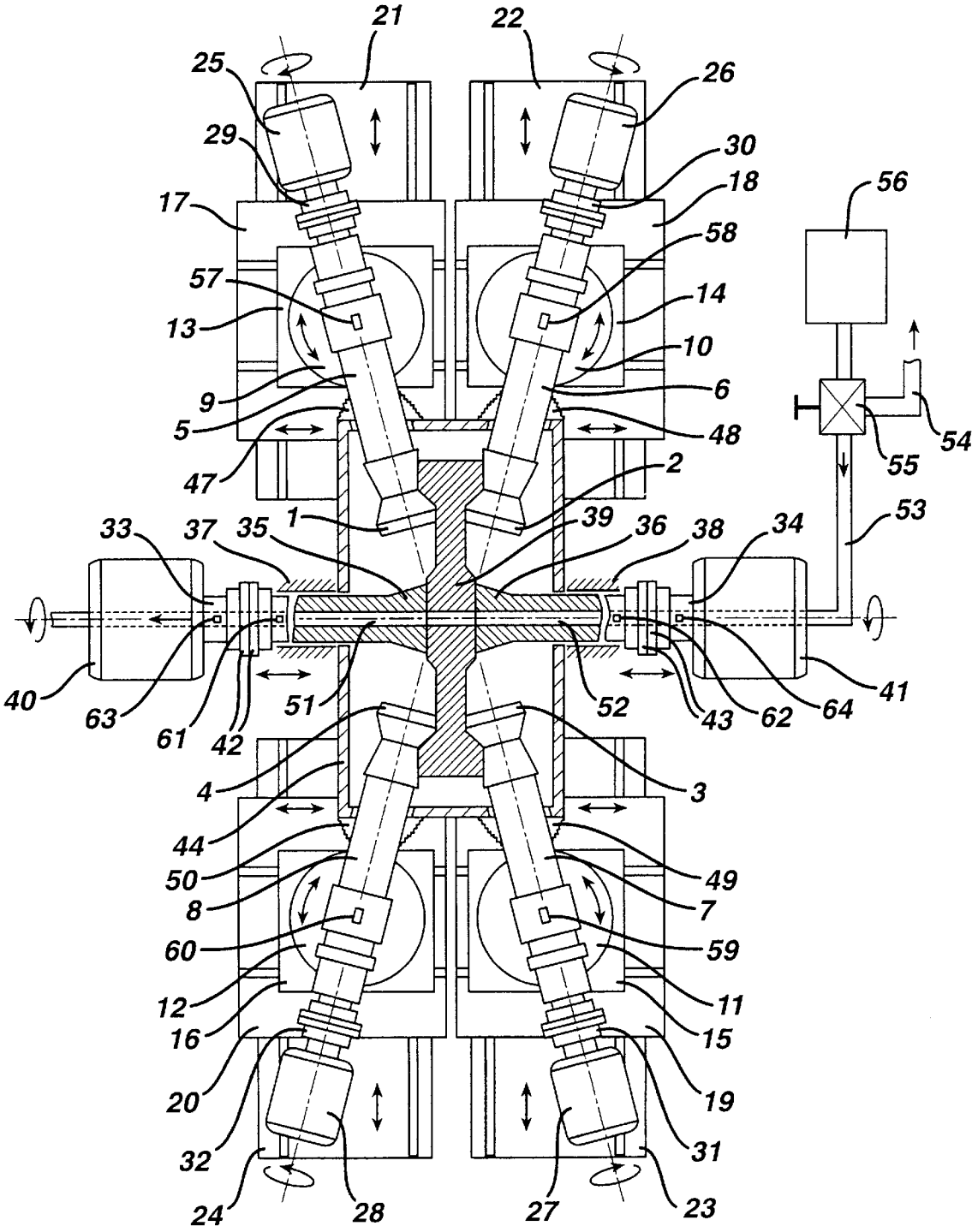
FIG. 1 illustrates a general schematic diagram of the proposed mill.

The proposed mill improved as described above allows utilizing the properties of the aforementioned hard-to-work alloys that are mutually inconsistent as to the forming process. The inconsistency resides in that at low working temperatures to produce a part having the required shape is virtually impossible due to high strain resistance, inadequate plasticity, and a small strain center, and conversely, at high working temperatures corresponding to high or superplastic conditions, low yield stress values, and a large strain center exceeding considerably the tool-to-billet contact area are causative of uncontrolled additional strain of the already formed billet portion. It is in both cases that difficulties are encountered in forming of parts from such alloys using the local straining technique.

It is due to the provision of novel construction elements that the mill proposed in the present invention contributes to changes in the level of forces exerted by the tool on the billet and in the strain resistance of the billet material, as well as in the strain centers, whereby a preset forming of the billet is attained. In addition, high quality of parts produced is provided due to establishing specified structures in the material of parts.

Thus, the mill construction further comprises a device for establishing a specified temperatures gradient adapted to control the temperature over the billet cross-sectional area, thereby effecting control over the aforementioned levels of stresses and the strain center in the billet under process. The device makes it also possible to use a controlled temperature pattern in the billet under process so as to established a specified microstructure over the billet cross-sectional area.

There are proposed two basic approaches to the construction arrangement of the device for establishing a specified temperature gradient in the billet under process, one of which is based on a possibility of nonuniform heating of the billet under process made of superalloys, in which their low thermal conductivity promotes such heating. A number of variants of said construction arrangement are practicable. The device for establishing a specified temperature gradient in the billet under process may be functionally integrated with the working furnace. In this case a differentiated billet heating in the furnace is provided due to updating the furnace by furnishing it with independent variable-power heaters, which may be arranged along concentric circles coaxial with the axis of the billet being rolled. Each of the heaters is lodged in a recess of the furnace wall and has its own reflector that focuses a heat radiation flux on an area exposed to local heating.

Another approach to the construction arrangement of said device is based on cooling a preheated billet. In this case the device comprises a source of refrigerant communicating with the billet holding units through pipings, and the refrigerant is fed to the working furnace and cools the preheated billet from its center towards the periphery, which proves to be very efficient for a majority of billets being rolled. The source of refrigerant may also communicate with the rolling heads. In such a case the cooling is very efficient due to the fact that the device is movable, thus intercooling the rolled billet portion located immediately after that being rolled. A number of combinations of said variants are practicable.

The device for establishing a specified temperature gradient in the billet under process contributes to establishing a specified billet microstructure due to temperature distribution over its cross-sectional area. Thus, in such parts as disks of gas-turbine engines it is reasonable to establish a fine-grained microstructure in the hub, a "necklace"-type microstructure in the web, and a coarse-grained one in the rim of the disk. Provision of said device makes possible heating the portion billet being rolled having an original fine-grained microstructure to the recrystallization temperature, and heating the central portion, i.e., the hub to a temperature below the recrystallization temperature. Thereupon once the grains have somewhat grown, the temperature of the billet area being rolled is reduced to that at which the microstructure of the "necklace" type is established during the strain process. Next the temperature is changed again so that the obtained microstructures be retained in the hub and web, whereas a coarse microstructure be established in the disk rim.

The level of stresses in the billet can be controlled, according to the invention, by changing a stressed state pattern, as well as forces and torques applied to the billet. In particular, provision of load sensors makes possible measuring the values of forces and torques applied to the billet, which can then be changed by manipulating tool and billet actuators. A force is applied to each roll and hence the billet, which is reasonable to be measured and controlled along the following three dimensions, a radial (lengthwise the billet radius), an axial (collinear with the disk axis), and tangential (along the tangent line to a circumference drawn through the center of the contact pattern). The values of said force and of the components thereof are controlled by changing either the speed and position of the rolls and billet or the direction of force application, i.e., the force vector. The latter is provided due to the provision of a mechanism for reversing the direction of tool and billet rotation. In addition, the stressed state is controlled by selecting an appropriate combination of tools rotating either positively or freely, as well as a billet to be processed, which is provided by incorporating into the driving mechanism means adapted to change rotation of rolls and billet from positive to free.

Additionally, the mill can be provided with a mechanism for turning the tool in the plane square with the axis of billet rotation, thus setting the tool to a position, wherein the axis of its rotation is misaligned with the axis of the billet rotation. It is known from theory of rolling that it is important for billet reduction with rolls that the angle of biting the billet with the rolls is not to exceed the friction angle. When rolling billets with high-percent reduction, which is the case when the billet portions differ widely in thickness as in disks of gas-turbine engines, as well as in rolling with lubricant, the aforesaid theoretical recommendation is difficult to observe. That is why rolling is to be performed with a positive rotation of rolls and billet at coordinated speeds. On the other hand, a situation may be encountered, wherein the forces and torques resulting from the rolling tools and the billet holding unit establish a resultant torque which exerts a twisting action on the billet center relative to its periphery, this being due to impossibility of complete coordination of rotational speeds of the rolls and billet under process. In this case the mill, according to the invention, makes it possible, without disengaging low-response actuators, to bring part of the rotating rolls and/or the billet into free rotation for a period of time sufficient for eliminating the causes of distortion of the geometric shape of the billet under process in case of its twisting and thinning, and to re-engage said actuators with a view to increasing the efficiency of the rolling process.

Furthermore, provision of reversal of the tool (viz, rolling rolls) and billet enables one not only to change the direction of action of forces and torques applied to the billet under process but also to form very intricately shaped elements of the parts being produced. Thus, disk rim flanges can be raised by backward motion of the rolls towards the disk center, and disk-type parts featuring radial arrangement of ridge on the face surface thereof can be rolled by reversing tool and billet rotation.

Various mill operating conditions are also possible, whereby the level of effective stresses and the size of the strain center of the billet are changed due to free or positive rotation of the rolls, their reversal or stopping. For instance, as has been pointed out before, with the billet rotated positively from the billet holding unit and the rolls rotated also positively, favorable conditions arise at the beginning of the rolling process, though at the same time there occur stresses and twisting strain in the billet portion located between said tools. Therefore should such a danger be encountered the rolling conditions must be changed several times in the course of rolling one billet.

An additional load application pattern and the value of the load applied can also be changed by the action of the pressure roller on the billet under process. During the billet forming process said roller exerts a force on the billet, directed towards the axis of its rotation and hence reduces a total value of the radial force causing disk web thinning. To this end, the roller is provided with an actuator imparting radial motion thereto, while provision of another actuator imparting motion to said roller parallel to the billet axis makes possible forming of parts with a wide well developed rim. Thus, the pressure roller and the rolling rolls establish a rolling groove with a closed system of forces.

As a rule, the billet contour sensor makes part of an optoelectronic unit which comprises also a source of light incident on the billet surface, and a receiver of reflected light rays. Angles of reflection and intensity of reflected light rays vary in response to any deviation of the thickness of the billet portion being rolled from the specified value. Operation of the tool and billet actuators or of the device for establishing a specified temperature gradient in the billet under process is corrected in accordance with the value of an error signal resulting from a change in the billet contour. Thus, for example, when the web of the disk being produced is liable to be distorted due to accidental disturbances, an appropriate correction is inserted in the tool position for the dimensions of the billet contour to remain within the tolerance limits. Should the rolled-off disk web be found to have got thinned because the level of strain stresses in the disk zone involved exceeds strain resistance of the material, the corresponding actuators are put on to increase strain resistance of the billet material by, e.g., a more intense feeding of refrigerant to the rolled-off billet portion or, if said operation proves to be ineffective or is limited by any other reasons, strain rate is decreased by reducing the tool and billet speed. Whenever such a speed reduction is inexpedient as being responsible for a drop in the productivity, the value of some rolling force components by changing the position of rolls, in particular, by their appropriate turning.

Operation of the mill actuators when rolling disks using load sensors is based on that any substantial deviation in strain of the billet under process results in a change of the levels of forces and torques applied to the tool and billet. Thus, when one of the rolls assuming superposition exerts a higher force on the billet, hence said roll penetrates thereinto to a higher extent than the opposite roll. The process proceeds until the forces applied by the rolls get equal, though with the rolls assuming another position, with the result that the billet under process is subjected to a local shear with a higher billet thickness reduction ratio than that specified. A condition preventing the onset of such a defect is keeping up the equality $P_1=P_2$ for rolls of the same type as to shape and size, or the equality $p_1f_1=p_2f_2$for different-type rolls, where $P_1$, $P_2$ denote forces on the rolls, $p_1$, $p_2$ denote pressure exerted by the rolls, and $f_1$, $f_2$ stand for rolls-to-billet contact area. Whenever a distortion of the web occurs, i.e., that similar to a dish shape, it results from the presence of unbalanced torques $P_1R_1$ and $P_2R_2$ for each pair of rolls assuming superposition, where $R_1$, $R_2$ denote radii running from the axis of rotation to center of gravity of the tool-to-billet contact area, and $P_1$, $P_2$ denote the total reduced forces on the rolls assuming superposition. It is due to mismatch of the billet and tool rotation speeds that twisting of the rolled billet area and impairment of quality of its surface may occur. This is accompanied by higher torques on the rolls and the billet holding unit.

Violation of said relationships results in error signals delivered by the load sensors, against which an appropriate correction of operation of the actuators is performed. Thus, for instance, when the disk web is twisted this is counteracted either by changing the moment on the driving shaft of the billet holding unit or by strengthening the billet material by actuating the device for establishing a specified temperature gradient in the billet under process. The purpose can be also achieved by changing a positive rotation of rolls or billet for a free rotation thereof, i.e., rotation by virtue of friction forces effective in the zone of tool-to-billet contact, by disengaging either the tool or the billet from their rotation mechanisms.

Provision of load sensors and billet contour sensors provides a possibility of rolling the required part and obtaining a preset shape in a closed furnace without visual monitoring of the process. Said construction elements may be used in alternative embodiment of the proposed mill and jointly, in particular, for rolling intricately shaped parts. At the beginning of the rolling process use of the load sensors is more efficient because they enable one to determine the instant when the rolls get in contact with the billet. A higher measurement accuracy is attained during the rolling process by the billet contour measuring unit based on a contactless optoelectronic measuring system. Control of the mill with the aid of the aforementioned devices, mechanisms, and units can be effected by an operator, but more efficiently its control can be carried out using known elements of automatic systems which include control and monitoring instruments and apparatus, the aforementioned sensors, actuators, a computer, operational units with comparators, feedback channels, etc.

FIG. 1 presents a schematic diagram of a mill, comprising four inclined rolls 1, 2, 3, and 4 mounted in respective rolling heads 5, 6, 7, and 8 which are made fast on respective slewing platforms 9, 10, 11, and 12, the latter being in turn installed on respective top carriages 13, 14, 15, and 16 traversable along ways (not shown in FIG. 1) provided on bottom carriages 17, 18, 19, and 20. In their turn said carriages are movable along ways provided on bed portions indicated with reference numbers 21, 22, 23, and 24. The mill further comprises actuators imparting rotation to said rolls, said actuators appearing as geared electric motors 25, 26, 27, and 28 coupled, through clutches 29, 30, 31, and 32, to said rolling heads. The mill also comprises two coaxial movable cross-pieces 33, 34 with poppet sleeves 35, 36, said cross-pieces being mounted in ways 37, 38 and intended for holding a billet 39 under process, and actuators appearing as geared electric motors 40, 41 imparting rotation to said poppet sleeves through clutches 42, 43. The mill further comprises a working furnace 44 provided with openings for inserting the rotatable portion of the rolling heads 5, 6, 7, and 8 with the rolls 1, 2, 3, and 4, and the poppet sleeves 45, 46. To reduce heat loss of the working furnace 44, the openings for inserting the rolling heads are provided with movable bellows 47, 48, 49, and 50. The furnace accommodates part of the device for establishing a specified temperature gradient in the billet under process (first variant) appearing as passages 51, 52 provided in the poppet sleeves and communicating, through pipings 53, 54 and a distribution cock 55, with a refrigerant source 56. Provision is made in the furnace and poppet sleeves for temperature sensors (omitted in FIG. 1). The mill further comprises load sensors 57, 58, 59, and 60 adapted to measure the axial, radial, and tangential components of the rolling force, as well as load sensors in the form of axial force pickups 61, 62 and torque pickups 63, 64 provided in the billet holding unit.

Figure 2:
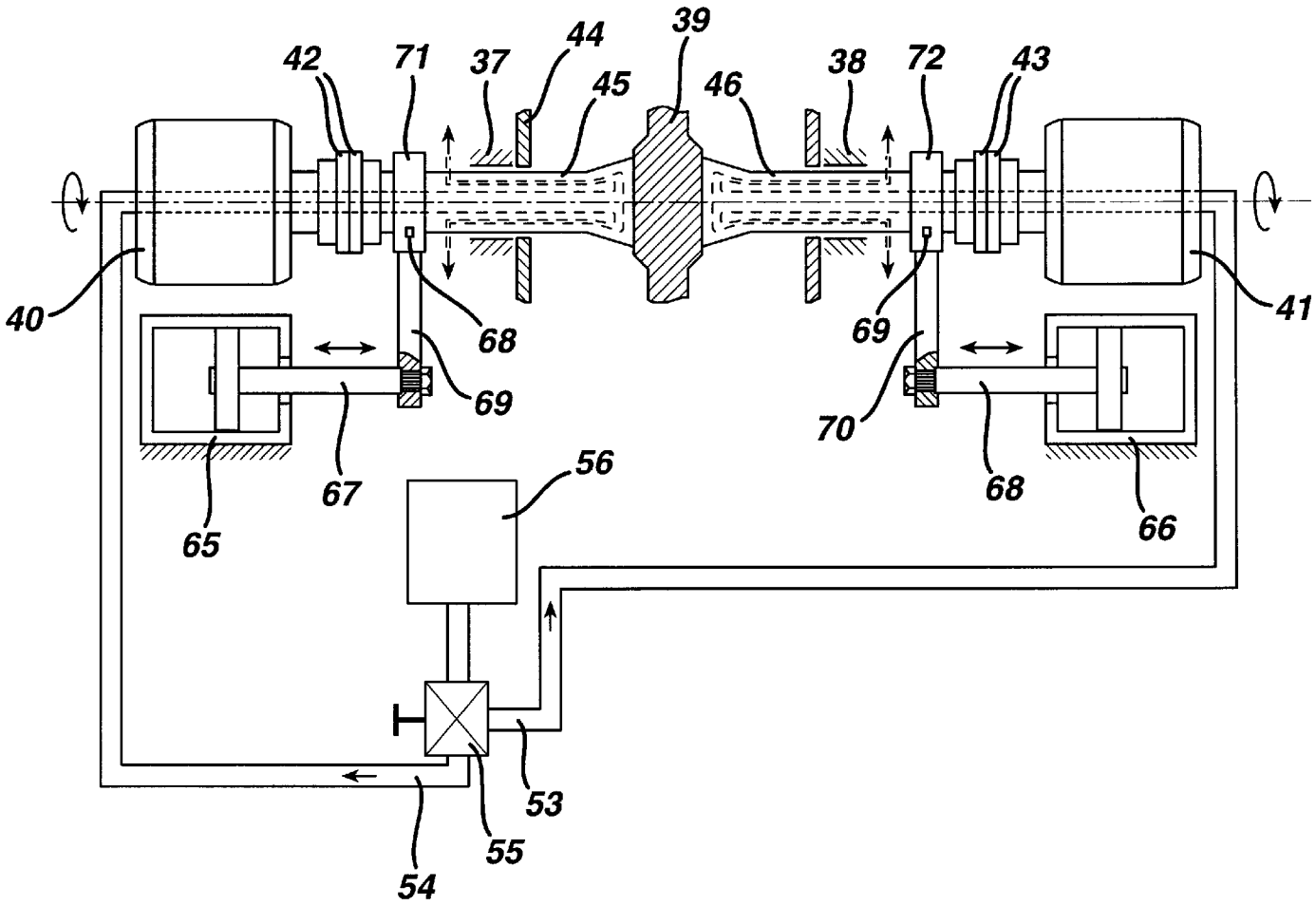
FIG. 2 presents a billet holding unit with actuators.

FIG. 2 shows the billet holding unit with actuators 65, 66 appearing as hydraulic cylinders adapted to impart axial motion to the billet holding unit by rods 67, 68, brackets 69, 70, and bearings units 71, 72 with the poppet sleeves of the billet holding unit. Further FIG. 2 illustrates a first embodiment of the device for establishing a temperature gradient in the billet under process by its cooling on both sides with the refrigerant fed from its source 56.

Figure 3:
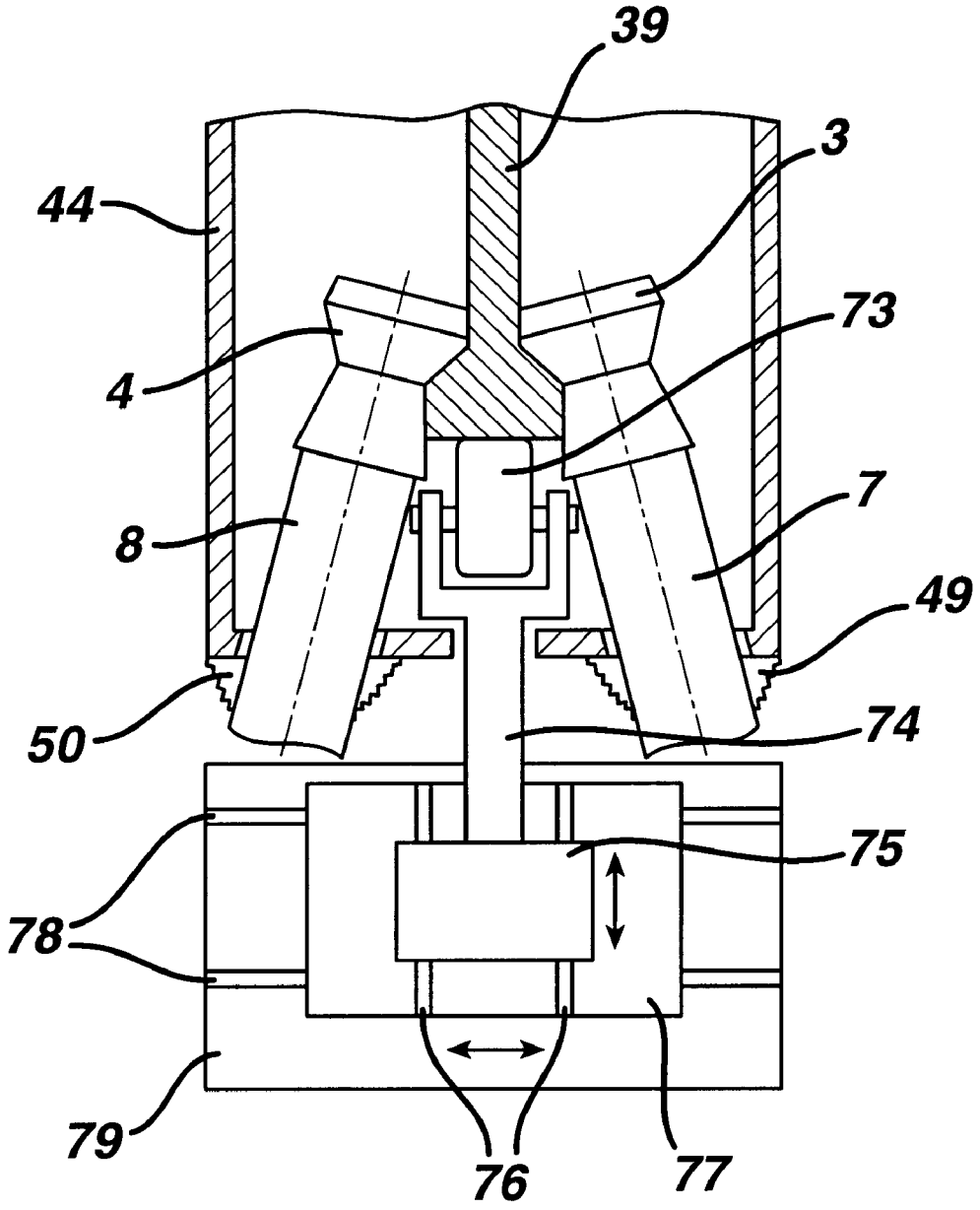
FIG. 3 shows the arrangement of rolling rolls and a pressure roller.

FIG. 3 illustrates the arrangement of the rolling rolls 3, 4 and a pressure roller 73, wherein the latter is rotatable in a roller holder 74 which in turn is mounted on a movable top platform 75 radially movable along ways 76 fixed in place on a bottom platform 77. In its turn the bottom platform 77 is mounted in ways 78 fixed stationary on a bed portion 79.

Figure 4:
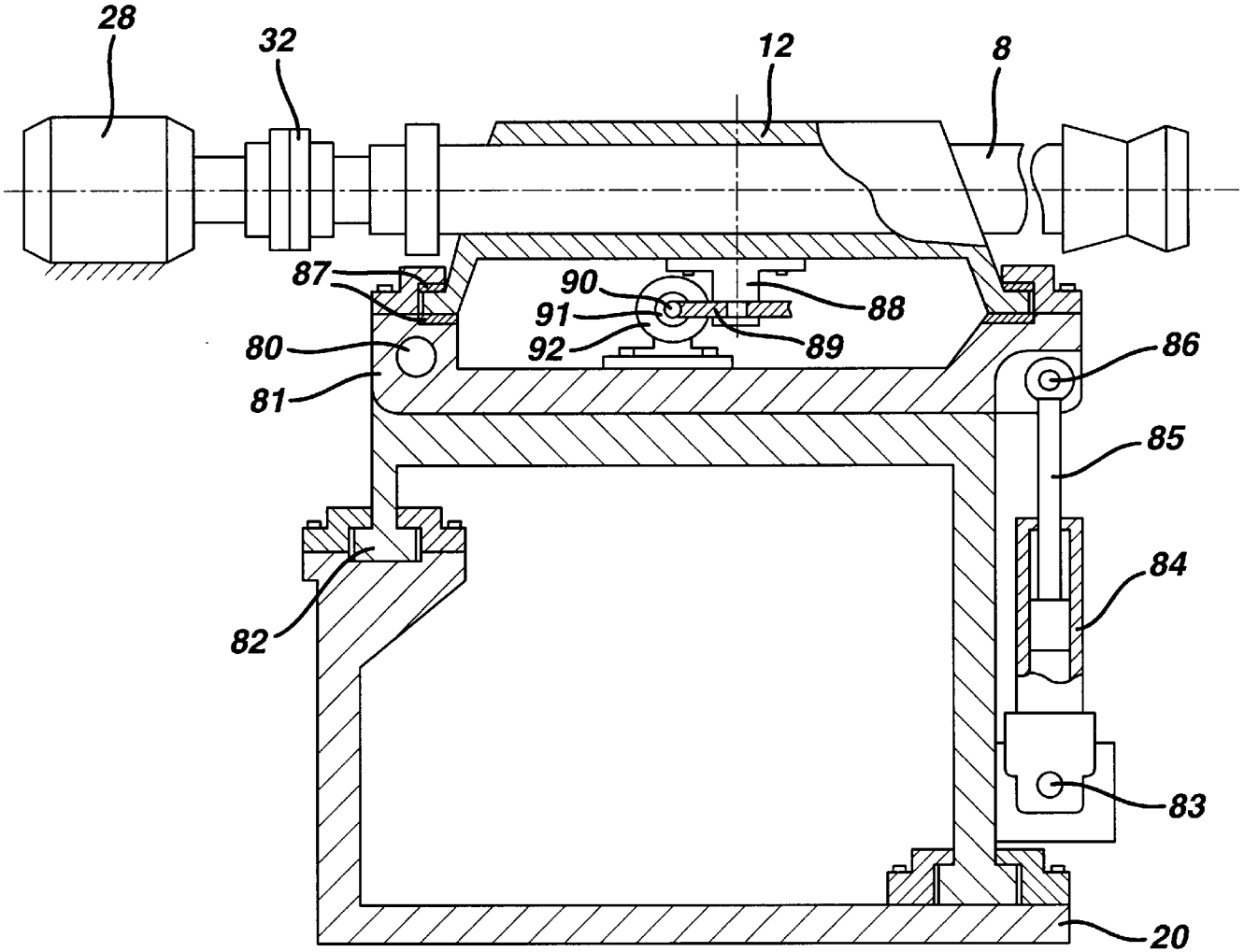
FIG. 4 shows actuators which turn the roll in the planes square with the axis plane of billet rotation.

FIG. 4 illustrates, with reference to one of the rolling heads, actuators that impart turning motion to the inclined roll 4 in the planes square with the billet axis and plane of rotation. It is obvious from FIG. 4 that the top carriage 16 is made up of two members interconnected through a hinge joint 80, i.e., an upper rotatable member 81 and a lower stationary fixed member 82. The top carriage 16 mounts also an actuator, that is, a hydraulic cylinder 84 which is installed thereon by a hinge joint 83 and is adapted to rotate the upper carriage member 81 with respect to its lower member 82 by means a cylinder rod 85 connected to the upper carriage member 81 through a hinge joint 86.

The rotatable carriage member 81 mounts the platform 12 with the rolling head 8. A worm wheel 89 is rigidly coupled, through an axle 88, to the platform 12, and a worm screw 90 connected to the stationary fixed carriage member 82, is linked, through a clutch 91, to a motor 92. The lower member 82 of the top carriage 16 is movable parallel to the billet axis along ways fixed in place on the bottom carriage 20.

Figure 5:
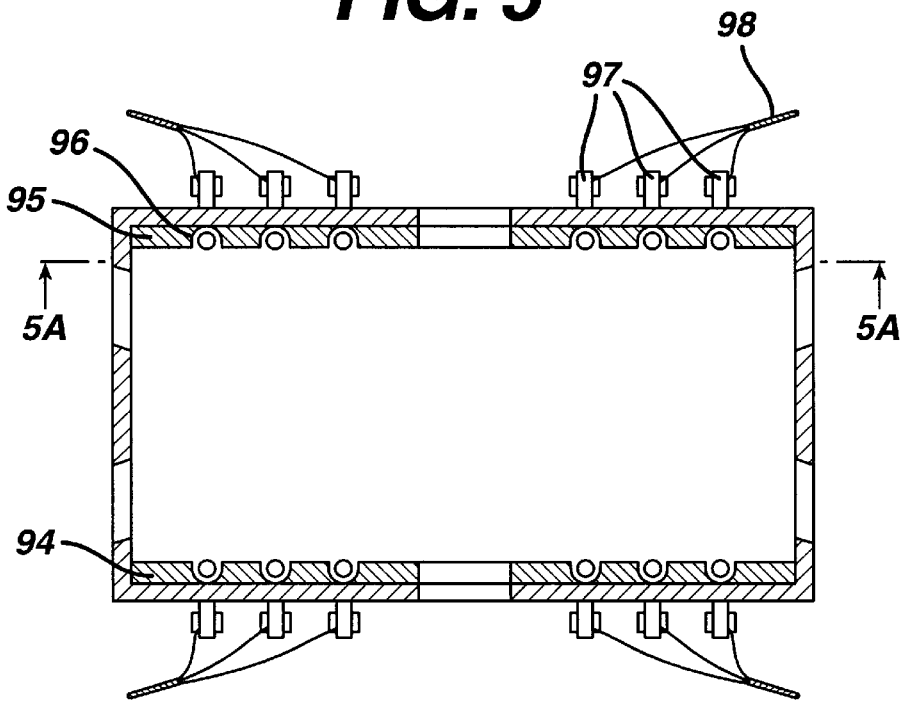
FIG. 5 depicts a device for establishing a specified temperature gradient in the billet under process.
Figure 5A:
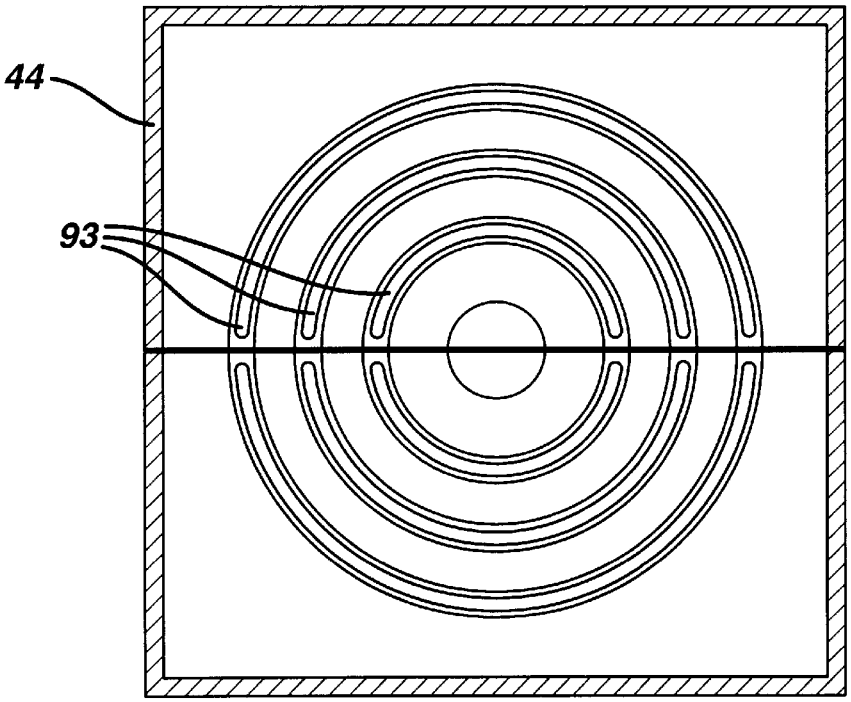

FIG. 5 illustrates the device for establishing a specified temperature gradient in the billet under process (second variant) which is constructionally integrated with the furnace 44. The device comprises heaters 93 arranged in the furnace 44 on concentric circles coaxial with the billet under process, each of the heaters being lodged in its own recess made in furnace walls 94 and 95 and having its own reflector 96. The heaters are so selected according to their output power as to provide gradient heating of the billet under process; they have their own electric terminals 97 connected, through a wire conductor 98, to a source of electric power (said source being omitted in FIG. 5).

Figure 6:
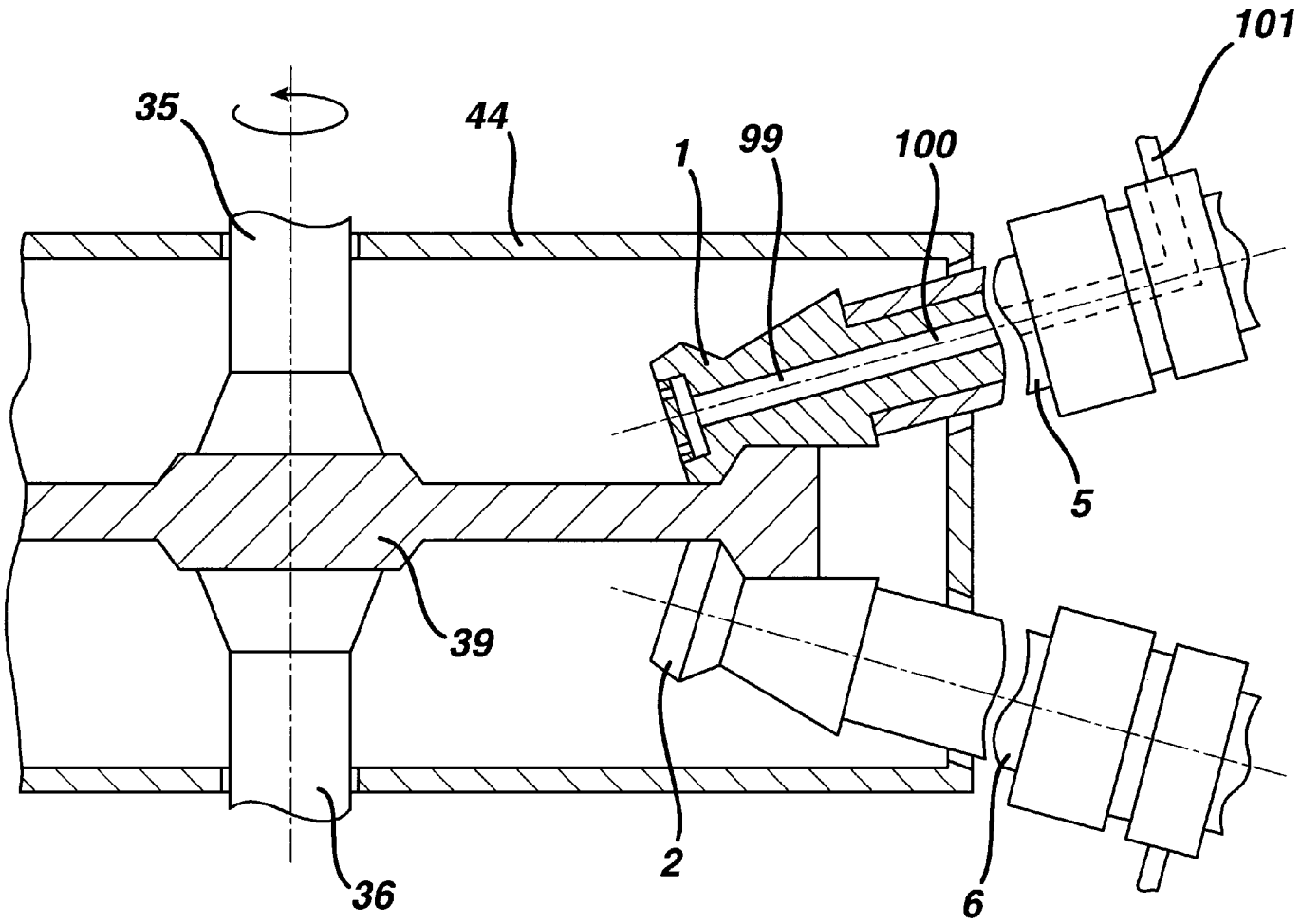
FIG. 6 depicts a device for establishing a specified temperature gradient in the billet under process.

FIG. 6 illustrates the device for establishing a specified temperature gradient in the billet under process (third variant) appearing as passages 99 provided in the roll 1 and having their outlets on the roll end face, said passages communicating, through an opening 100 in the rolling head 5 and along pipings 101, with the distribution cock 55.

Figure 7:
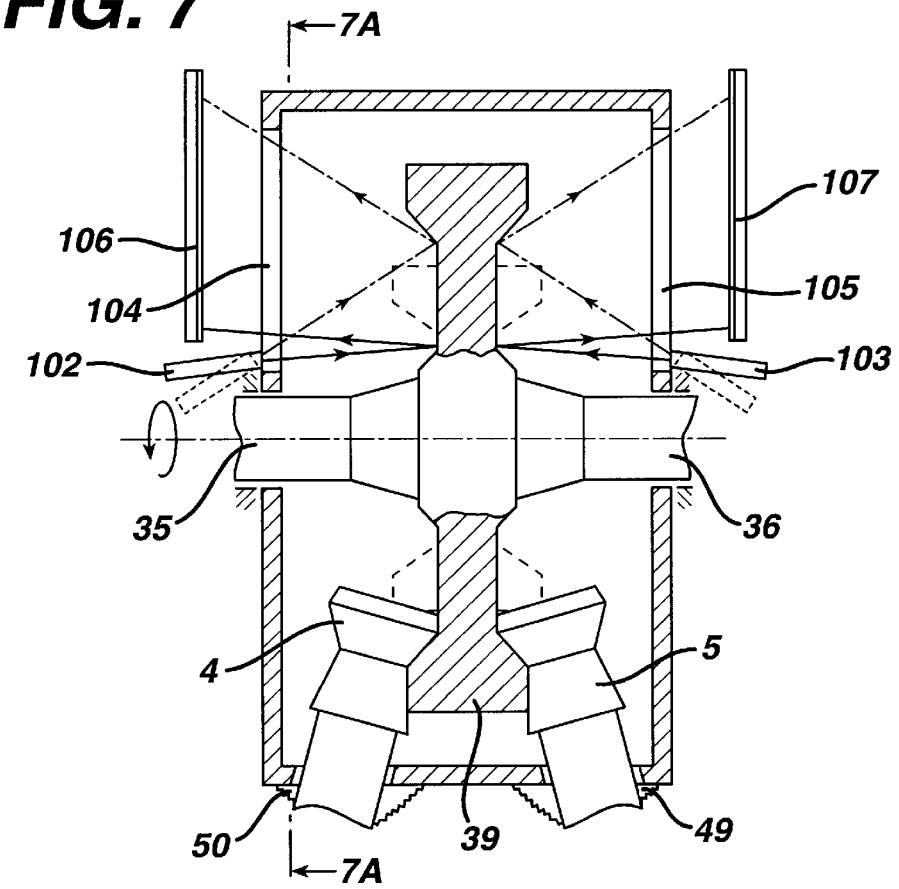
FIG. 7 illustrates the arrangement of a billet contour monitoring unit.
Figure 7A:
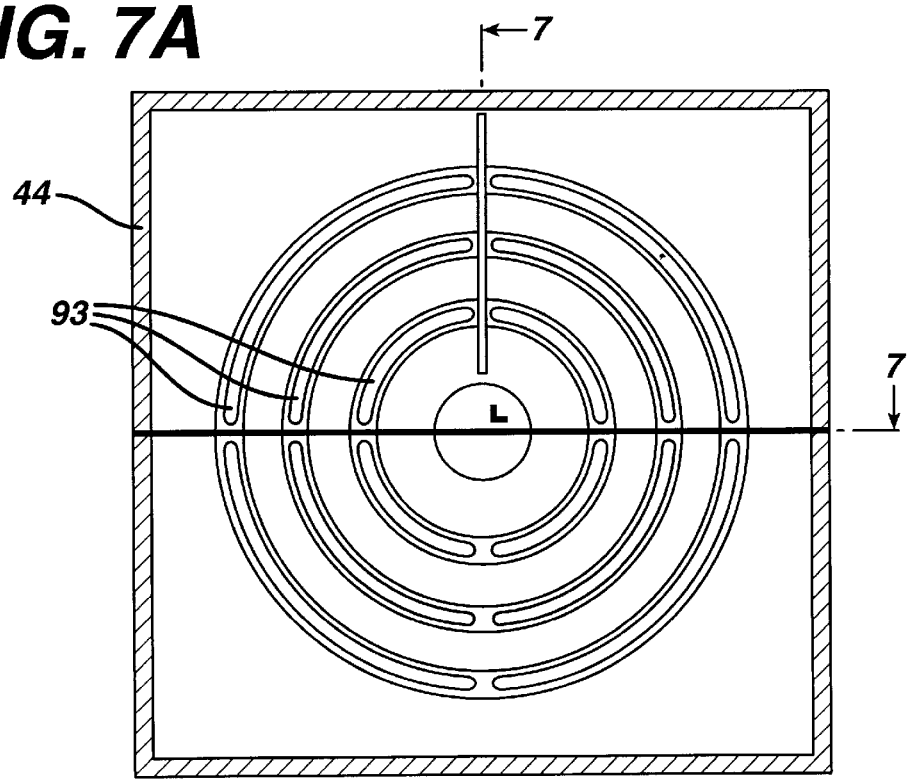

FIG. 7 shows the arrangement of the billet contour monitoring unit incorporating billet contour sensors 102, 103 located outside the furnace 44 and adapted to emit focused incident rays through transparent areas 104, 105 of the furnace wall on the billet surface and to turn their optical axes within the billet dimensional limits, as well as linear photodetectors 106, 107 of reflected rays. In addition, the photodetectors 106, 107 serve at the same time as additional temperature sensors adapted to measure the billet temperature, and are connected, through the control system (omitted in FIG. 7), to the device for establishing a specified temperature gradient in the billet under process.

Exemplary Embodiments of the Invention

EXAMPLE 1

The billet 39 from an ultrafine-grained microstructure alloy, grade EP962 preheated together with its centering axle, is set between the poppet sleeves 35, 36 of the billet holding unit in the working furnace 44 and is then fixed in position by compressing its hub with the poppet sleeves 35, 36. To establish a maximum contact area between the billet 39 and the poppet sleeves 35, 36, said poppet sleeves first compress the hub by applying thereto a force resulting in its plastic strain, whereupon the applied force is reduced to the values that cause but elastic strain in the hub. The aforesaid forces of compression and straining of the billet 39 are monitored by the respective sensors 61, 62. Next the billet 39 along with the poppet sleeves 35, 36 receives rotation from the respective actuators 40, 41. With the mill in the initial position, the rotating rolls 1, 2, 3, 4 are brought in contact with the billet 39 before beginning the rolling process, using load sensors 57,58, 59, 60 which deliver a corresponding signal in response to a roll-to-billet contact force. In addition, use is also made of readings displayed by the rolling head position pickups (not shown), for setting the rolls 1, 2, 3, 4 at a required angle and for a preset diameter of the billet 39, as well as rotation speed pickups (not shown) for coordinating rotation speed of the billet 39 with that of each roll. Simultaneously the billet contour sensors 102, 103 are adjusted for an initial position of the surfaces of the billet under process in a zone near the place of the roll-to-billet contact. Next the device for establishing a specified temperature gradient in the billet under process shown in FIGS. 1 and 5 is put on, with the result that the heaters 96 of said device shown in FIG. 5 preheat the billet portion under rolling to the strain temperature, while cooled air is fed to the hub along the passages 51, 52 in the poppet sleeves 35, 36 so as to cool the hub portion of the billet. The heating and cooling temperatures of the billet 39 are controlled, in a first approximation, by temperature sensors (not shown) provided in the poppet sleeves 35, 36 located in the furnace and in the cooling zone, respectively. Temperature distribution in the billet 39 is additionally monitored and corrected with the aid of, e.g, the detector 106 of the billet contour monitoring unit shown in FIG. 7 and appearing as a photometric rule adapted to response, by appropriate signals, to the intensity and distribution of radiation from various points on the surface of the preheated billet. Once the strain temperature of the billet under process and a specified temperature gradient between the billet portion to be rolled and the hub have been attained, the rolling process begins by penetrating the rolls 1, 2, 3, 4 into the billet portion being rolled and their radial displacing, according to a program aimed at forming a preset contour of the billet 39 under process. Should any deviation from a preset contour occur during the rolling process due to the effect of various factors (such as temperature, elastic strain of tools, inhomogeneous initial microstructure of the material, changes in the rolling forces and torques, or other occasional or systematic reasons), the rolling conditions are readjusted, using load sensors 57, 58, 59, 60 and/or the billet contour sensor 102, 103, which deliver appropriate signals to the respective mill actuators. Thus, for instance, if such deviations encountered when rolling a disk result in an abnormally increased thickness of the disk web, or the disk is liable to get locally distorted in the rolling zone, operation of the actuators responsible for the position of rolls is to be corrected, one of said actuators being shown in FIG. 4 to comprise the units 89, 90, 91, and 92. When the rolled portion of the billet 39 gets distorted, operation of the device for establishing a specified temperature gradient in the billet under process and/or of the actuators 84, 85 that modify forces and torques applied to the tools, and of the actuators 25, 26, 27, and 28 that do this with respect to the billet. Thus, when the web rolled portion gets abnormally thinned, the resultant error signal is used for eliminating said adverse effect by various ways, that is, first by an increased intensity of billet cooling, using the passages 51, 52 provided in the poppet sleeves 35, 36, then using the passage 99 provided in the rolls 1, 2, 3, 4. If said measures are ineffective, a command signal is delivered to disengage the clutches 29, 30, 31, 32, and 42, 43 from the actuators of positive rotation of the billet and part of the rolls right up to rolling with only one roll or the billet rotating positively. Ultimately, if the measures taken are of no avail, the strain rate, i.e., the tool translational speed is to be reduced, or the tool position is changed by its being turned in the planes square with the axis of its rotation.

Thus, Example 1 demonstrates a combination of a number of construction embodiments of the device for establishing a specified temperature gradient in the billet under process, which is most efficient in industrial applications of the present invention.

EXAMPLE 2

Mill operation is considered with reference to rolling the desired part from a billet made of a fine-grained microstructure alloy, grade EP962 having configuration shown in FIG. 8, with a view to obtaining the required configuration with a specified cross-sectional microstructure changing from the fine-grained one in the hub, the "necklace"-type in the web, to the coarse-grained in the rim.

The mill operates as in Example 1 but with due account of the following specific features necessitated by obtaining the required configuration and specified cross-sectional microstructure.

Figure 8A:
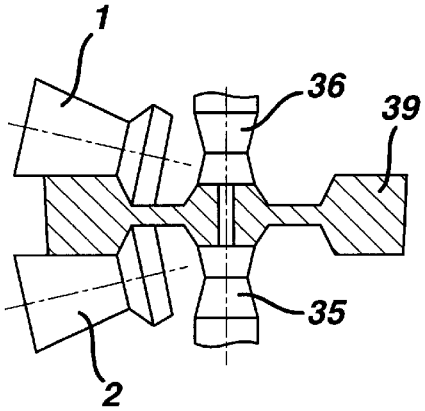
FIG. 8 shows a schematic diagram illustrating mill operation when rolling an intricately shaped disk asymmetric with respect to the plane square with the axis thereof.

Once the procedures with the mill as described in Example 1 and required for starting the rolling process have been performed, the rolls move from point A to point B as shown in the diagram of FIG. 8*a*. While the rolls are moving half the distance between said points the temperature of the billet portion under rolling is increased and that of the hub remains invariable by using the device for establishing a specified temperature gradient. The temperature of the billet portion being rolled is raised and the alloy is held at that temperature until the grain size in said billet portion gets equal to 60–80 microns. For this particular alloy said temperature ranges from 1150 to 1170 C. and the holding time, from 10 to 20 min. Thereupon the temperature of the billet portion being rolled is decreased, using the device for establishing a specified temperature gradient in the billet under process, to the values approximating the initial temperature, which is monitored by the temperature sensors in the billet. Further on the rolling process proceeds (from point B to point C in FIG. 8*b*) at a constant temperature of the billet portion being rolled. The process of forming the rim flange of the disk starts at point C in said diagram. The roll 1 receives command signals for motion aimed at its tracing the contour of the rim flange at points C, D, E, F on the billet as shown in FIG. 8. At the same time the roll 2 is decelerated on the respective path length, because it is important in this case that the relation $F_1S_1=F_2S_2$, i.e., equality of the forces applied be satisfied (FIG. 8*c, d*).

Figure 8D:
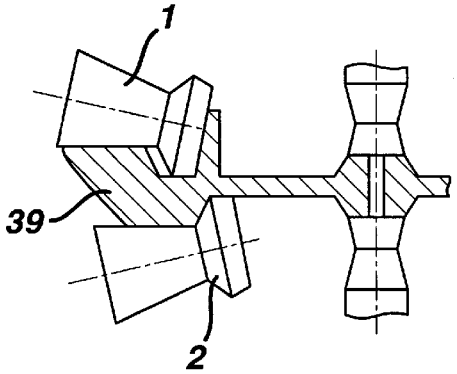
Figure 8B:
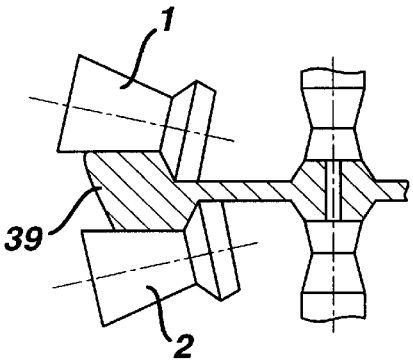
Figure 8E:
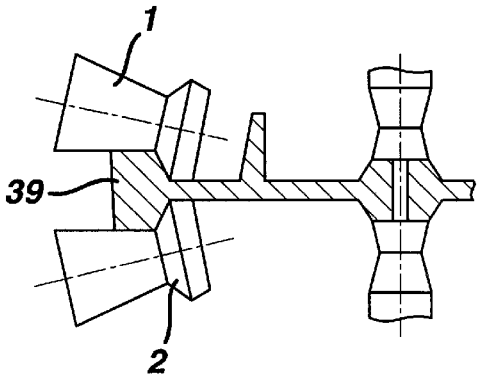
Figure 8C:
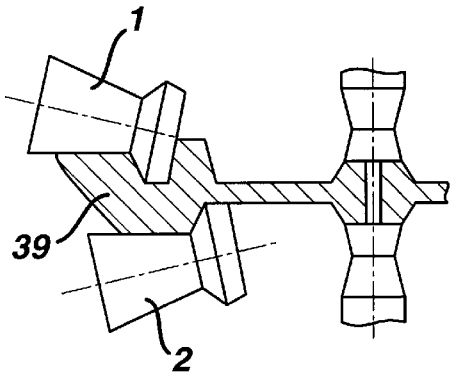
Figure 8F:
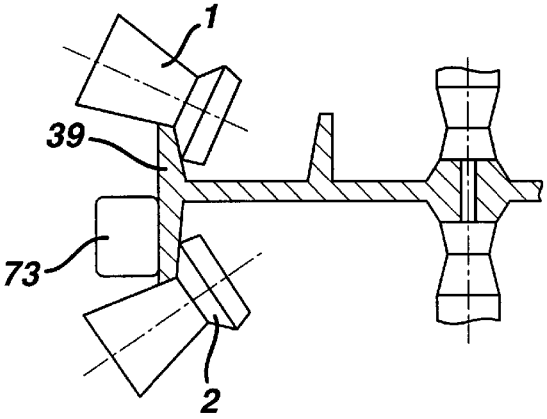

Further on the roll 1 moves in the opposite direction from point E radially to point E' so as to raise the rim flange at the cost of reduction of its thickness (FIG. 8*d*). In this case the roll 2 is placed in superposition to the top roll so as to observe equilibrium of torques thereof.

Once the rim flange has been formed, which is judged against the billet contour sensor, the rolls return as far as point G and move further radially to point H. For finish rolling of the disk rim portion the operating conditions of the device for establishing a specified temperature gradient are changed, namely, the rim heating temperature is raised but not in excess of the temperature at which the microstructure is coarsened, or grain size variations occur. Simultaneously refrigerant is fed to the poppet sleeves and onto the rolled disk portion at a higher rate in order to maintain a temperature therein 30–50 C. below the temperature of complete dissolution of gamma-prime phase. At the final stage of rolling where the disk is rolled off to the size equal to 85–90% of its finished diameter, the pressure roller is advanced to the disk rim portion and the latter is finish-formed by joint motion of the pressure roller and the inclined rolls. In this case the rim is rolled with its being spread, i.e., raised in height (thickness), by appropriately selecting the motion speeds of or forces on the pressure roller and the inclined rolls. Furthermore, when forming a high rim exceeding the width of the pressure roller working surface, said roller is periodically shifted lengthwise the disk axis from the bottom roll to the top one, and vice versa, until the billet contour sensor delivers a signal on termination of the rolling process. In this case the features of stopping and reversing the mill actuators are used.

EXAMPLE 3

Figure 9A:
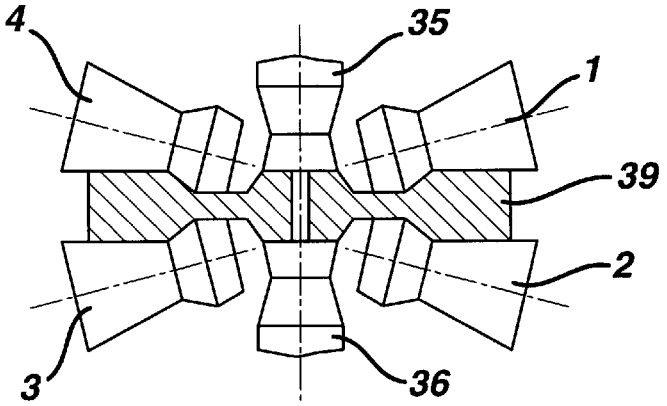
FIG. 9 shows a schematic diagram illustrating mill operation when rolling a part of the hemisphere type.
Figure 9B:
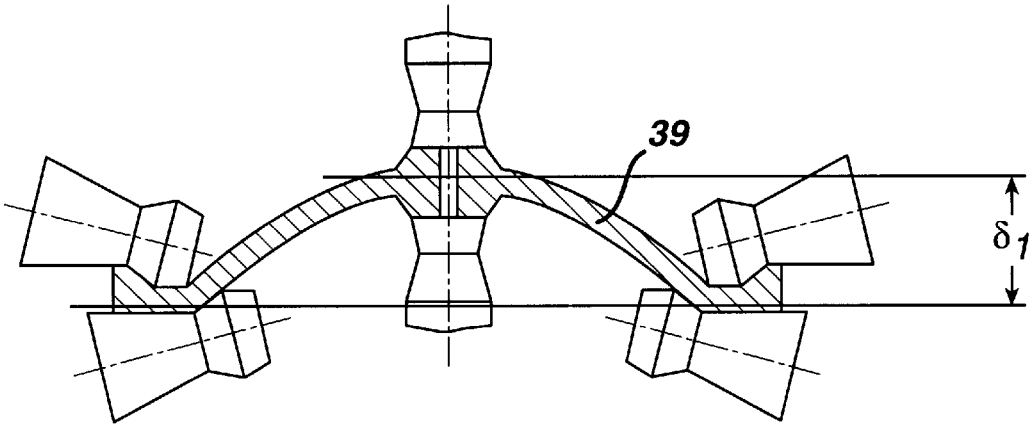
Figure 9C:
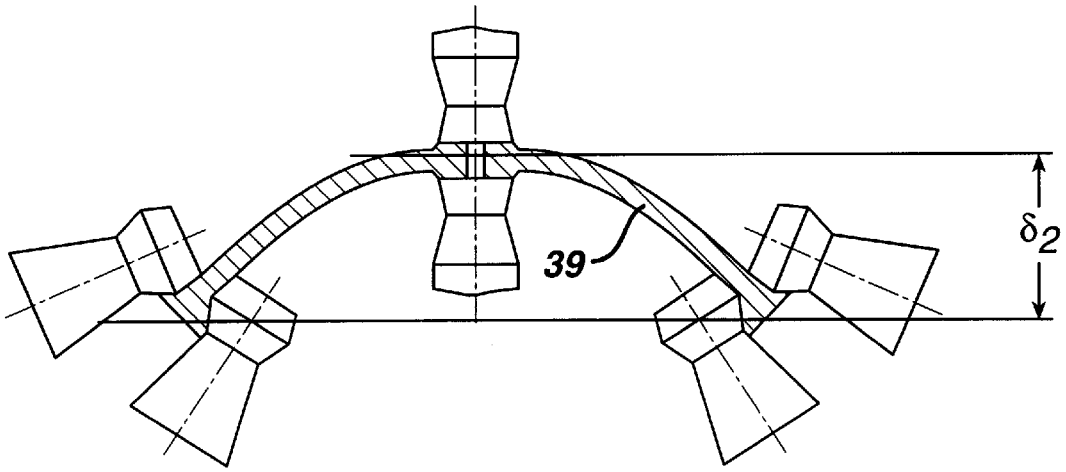

Mill operation is considered with reference to rolling a hemisphere-shaped part from a billet made of a titanium alloy, grade VT9 (FIG. 9).

The billet of the part to be produced preheated to the strain temperature (950 C.) is set and clamped in the poppet sleeves 35, 36, whereupon the mill actuators (not shown) are put on so as to advance the rolls to the billet and to roll the latter.

A peculiar feature of rolling a hemispherical part resides in that as the rolls change their position while moving radially according to a definite program, command signals are delivered to the actuators effecting axial displacement of the poppet sleeves comprising parts and units 65, 66, 67, 68, 70, and 71 (FIG. 2) for their joint (synchronous) shifting relative to the initial position for a length sufficient to obtain a required curvature of the part being rolled. FIG. 9*a, b, c* illustrates the various phases of producing a hemisphere-shaped part, where the symbols delta-one and delta-two denote the lengths of displacement of the poppet sleeves. The formation of said part is monitored and corrected during rolling by the billet contour sensor 102, 103 (FIG. 7).

The present invention can find application in the aircraft engines industry, the power plant industry, and other branches of mechanical engineering, wherein use is made of axially symmetric parts made of superalloys, nickel- and titanium-base alloys, and those based on intermetallides.

What is claimed is:

1. A mill for producing an axially symmetrical part; comprising:

means for holding a billet rotatable around its own axis;

at least one rolling roll adapted to be in contact with the surface of the billet during processing;

means for setting in rotation at least said roll or said billet;

driving means to impart motion to said roll with respect to the surface of the billet under process;

a working furnace to receive the billet under process and its holding means, said furnace having an opening to receive said at least one rolling roll;

means including heaters arranged for establishing a temperature gradient between portions of the billet under process within said furnace; and means for control and monitoring of said means including heaters to control billet processing conditions, said means for control and monitoring comprising temperature sensors of the billet under process.

2. A mill as set forth in claim 1, wherein said means for establishing a temperature gradient in the billet under process appear as a number of heaters accommodated in the furnace and so arranged with respect to the billet under process and so selected as to output power thereof as to provide a required temperature gradient between the individual billet portions.

3. A mill as set forth in claim 2, wherein said heaters accommodated in the furnace are arranged along concentric circles coaxial with the billet under process and are lodged in recesses of the furnace wall.

4. A mill as set forth in claim 1, wherein said means for establishing a temperature gradient in the billet under process incorporate a source of coolant, and said billet holding means have passages for the coolant to admit and withdraw, said passages communicating with said source of coolant through pipings.

5. A mill as set forth in claim 1, wherein said means for establishing a temperature gradient in the billet under process incorporate a source of coolant, and the rolling rolls have passages for the coolant to admit and withdraw, said passages communicating with said source of coolant through pipings.

6. A mill as set forth in claim 1, wherein the openings of the working furnace for the rolling rolls to insert are provided with bellows.

7. A mill as set forth in claim 1, wherein signals produced by the temperature sensors of the billet under process are used to control said means for establishing a temperature gradient in the billet under process.

8. A mill for producing axially symmetric parts, comprising:

means for holding the billet under process with a possibility of its rotating about its own axis;

at least one rolling roll adapted to be in contact with the surface of the billet during its processing;

means for setting in rotation at least said roll or said billet;

driving means to impart motion to roll with respect to the surface of the billet under process;

a working furnace in which placed at least partly are the billet under process and its holding means, said furnace having openings for rolling rolls to insert therein;

means for establishing a temperature gradient between the individual portions of the billet under process; and means for control and monitoring of the billet processing conditions, said means comprising sensors of load applied to the rolling roll and billet under process, the signals of said sensors being used for control of said means for establishing a temperature gradient in the billet under process.

9. A mill as set forth in claim 8, wherein said means for establishing a temperature gradient in the billet under process appear as a number of heaters accommodated in the furnace and so arranged with respect to the billet under process and so selected as to output power as to provide a required temperature gradient between the individual billet portions.

10. A mill as set forth in claim 8, wherein said means for establishing a temperature gradient in the billet under process incorporate a source of coolant, and said billet holding means have passages for the coolant to admit and withdraw, said passages communicating with said source of coolant through pipings.

11. A mill as set forth in claim 8, wherein said means for establishing a temperature gradient in the billet under process incorporate a source of coolant, and the rolling rolls have passages for the coolant to admit and withdraw, said passages communicating with said source of coolant through pipings.

12. A mill for producing axially symmetric parts, comprising:

means for holding the billet under process with a possibility of its rotating about its own axis;

at least one rolling roll adapted to be in contact with the surface of the billet during its processing;

means for setting in rotation at least said roll or said billet;

driving means to impart motion to roll with respect to the surface of the billet under process;

a working furnace in which placed at least partly are the billet under process and its holding means, said furnace having openings for rolling rolls to insert therein;

means for establishing a temperature gradient between the individual portions of the billet under process; and means for control and monitoring of the billet processing conditions, said means comprising billet contour sensors whose signals are used to control said means for establishing a temperature gradient in the billet under process.

13. A mill as set forth in claim 12, wherein said billet contour sensors are optoelectronic ones.

14. A mill as set forth in claim 12, wherein said means for establishing a temperature gradient in the billet under process appear as a number of heaters accommodated in the furnace and so arranged with respect to the billet under process and so selected as to output power thereof as to provide a required temperature gradient between the individual billet portions.

15. A mill as set forth in claim 12, wherein said means for establishing a temperature gradient in the billet under process incorporate a source of coolant, and said billet holding means have passages for the coolant to admit and withdraw, said passages communicating with said source of coolant through pipings.

16. A mill as set forth in claim 12, wherein said means for establishing a temperature gradient in the billet under process incorporate a source of coolant, and the rolling rolls have passages for the coolant to admit and withdraw, said passages communicating with said source of coolant through pipings.

17. A mill for producing axially symmetric parts, comprising:

means for holding the billet under process with a possibility of its rotating about its own axis;

at least one rolling roll adapted to be in contact with the surface of the billet during its processing;

means for setting in rotation at least said roll or said billet, said means being adapted to reverse rotation of the billet and roll and disengage both of them from the driving means;

driving means to impart motion to roll with respect to the surface of the billet under process;

a working furnace in which placed at least partly are the billet under process and its holding means, said furnace having openings for rolling rolls to insert therein; and means for control and monitoring of the billet processing conditions.

18. A mill as set forth in claim 17, wherein said means for control and monitoring of the billet processing conditions comprise sensors of load applied to the roll and the billet under process whose signals are used to control said driving means for setting the billet in rotation and said driving means of rolling rolls.

19. A mill as set forth in claim 18, further comprising an additional pressure roller provided with driving means imparting translational motion thereto parallel to the axis of billet rotation and lengthwise the billet radius, said means being controlled by signals from said sensors of load applied to the rolling roll and the billet under process.

20. A mill as set forth in claim 18, wherein the rolling roll is provided with a mechanism adapted to displace said roll to a position where the axis of its rotation does not intersect the axis of billet rotation, said mechanism being controlled by signals from said sensors of load applied to the rolling roll and the billet under process.

21. A mill as set forth in claim 17, wherein said means for control and monitoring of the billet processing conditions comprise billet contour sensors whose signals are used to control said driving means of the billet under process and said driving means of rolling rolls.

22. A mill as set forth in claim 21, further comprising an additional pressure roller provided with driving means imparting translational motion thereto parallel to the axis of billet rotation and lengthwise the billet radius, said means being controlled by signals from said billet contour sensors.

23. A mill as set forth in claim 21, wherein the rolling roll is provided with a mechanism adapted to displace said roll to a position where the axis of its rotation does not intersect the axis of billet rotation, said mechanism being controlled by signals from said billet contour sensors.

24. A mill as set forth in claim 17, further comprising a mechanism adapted to displace the billet under process lengthwise its own axis.

25. A mill for producing an axially symmetrical part; comprising:

means for holding a billet rotatable around its own axis;

at least one rolling roll adapted to be in contact with the surface of the billet during processing;

means for setting in rotation at least said roll or said billet, said means being adapted to reverse rotation of the billet and roll and disengage both of them from a driving means;

driving means to impart motion to said roll with respect to the surface of the billet under process;

a working furnace to receive the billet under process and its holding means, said furnace having an opening to receive said at least one rolling roll;

means for establishing a temperature gradient between portions of the billet under process; and means for control and monitoring of said billet processing conditions.

26. A mill as set forth in claim 25, wherein said means for establishing a temperature gradient in the billet under process appear as a number of heaters accommodated in the furnace and so arranged with respect to the billet under process and so selected as to output power thereof as to provide a required temperature gradient between the individual billet portions.

27. A mill as set forth in claim 26, wherein said heaters accommodated in the furnace are arranged along concentric circles coaxial with the billet under process and are lodged in recesses of the furnace wall.

28. A mill as set forth in claim 25, wherein said means for A mill as set forth in claim 1, wherein said means for establishing a temperature gradient in the billet under process incorporate a source of coolant, and said billet holding means have passages for the coolant to admit and withdraw, said passages communicating with said source of coolant through pipings.

29. A mill as set forth in claim 25, wherein said means for establishing a temperature gradient in the billet under process incorporate a source of coolant, and the rolling rolls have passages for the coolant to admit and withdraw, said passages communicating with said source of coolant through pipings.

30. A mill as set forth in claim 25, wherein the openings of the working furnace for the rolling rolls to insert are provided with bellows.

31. A mill as set forth in claim 25, wherein said means for control and monitoring of the billet processing conditions comprise temperature sensors of the billet under process whose signals are used to control said means for establishing a temperature gradient in the billet under process.

32. A mill as set forth in claim 25, wherein said means for control and monitoring of the billet processing conditions comprise sensors of load applied to the roll and the billet under process whose signals are used for control of said driving means for setting the billet in rotation and said driving means of rolling rolls.

33. A mill as set forth in claim 32, wherein the rolling roll is provided with a mechanism adapted to displace said roll to a position where the axis of its rotation does not intersect the axis of billet rotation, said mechanism being controlled by signals from said sensors of load applied to the rolling roll and the billet under process.

34. A mill as set forth in claim 32, further comprising an additional pressure roller provided with driving means imparting translational motion thereto parallel to the axis of billet rotation and lengthwise the billet radius, said means being controlled by signals from said sensors of load applied to the rolling roll and the billet under process.

35. A mill as set forth in claim 25, wherein said means for control and monitoring of the billet processing conditions comprise billet contour sensors whose signals are used to control said driving means of the billet under process and said driving means of rolling rolls.

36. A mill as set forth in claim 35, wherein the rolling roll is provided with a mechanism adapted to displace said roll to a position where the axis of its rotation does not intersect the axis of billet rotation, said mechanism being controlled by signals from said billet contour sensors.

37. A mill as set forth in claim 35, further comprising an additional pressure roller provided with driving means imparting translational motion thereto parallel to the axis of billet rotation and lengthwise the billet radius, said means being controlled by signals from said billet contour sensors.

38. A mill as set forth in claim 25, wherein said means for control and monitoring of the billet processing conditions comprise sensors of load applied to the roll and the billet under process whose signals are used to control said means for establishing a temperature gradient in the billet under process.

39. A mill as set forth in claim 25, wherein said means for control and monitoring of the billet processing conditions comprise billet contour sensors whose signals are used to control said means for establishing a temperature gradient in the billet under process.

40. A mill as set forth in claim 25, further comprising a mechanism adapted to displace the billet under process lengthwise its own axis.

* * * * *